US012692755B2

(12) United States Patent
Freyer et al.

(10) Patent No.: US 12,692,755 B2
(45) Date of Patent: Jul. 28, 2026

(54) ALIGNABLE GUIDANCE DEVICE FOR CASING ENTRY MILLING AND CEMENTING OPERATIONS

(71) Applicant: Scientific Drilling International, Inc., Houston, TX (US)

(72) Inventors: Carsten Freyer, Wienhausen (DE); Gerald Heisig, Houston, TX (US); Mario Simanowski, Meinersen (DE)

(73) Assignee: Scientific Drilling International, Inc., Houston, TX (US)

( * ) Notice: Subject to any disclaimer, the term of this patent is extended or adjusted under 35 U.S.C. 154(b) by 0 days.

(21) Appl. No.: 19/031,581

(22) Filed: Jan. 18, 2025

(65) Prior Publication Data

US 2025/0163764 A1 May 22, 2025

Related U.S. Application Data

(63) Continuation-in-part of application No. 18/518,033, filed on Nov. 22, 2023.

(60) Provisional application No. 63/434,987, filed on Dec. 23, 2022.

(51) Int. Cl.

| | |
|---|---|
| ***E21B 17/14*** | (2006.01) |
| ***E21B 29/06*** | (2006.01) |
| ***E21B 45/00*** | (2006.01) |
| ***E21B 47/13*** | (2012.01) |

(52) U.S. Cl.

CPC ..... *E21B 17/14* (2013.01); *E21B 45/00* (2013.01); *E21B 47/13* (2020.05); *E21B 29/06* (2013.01)

(58) Field of Classification Search

CPC ..... E21B 29/06; E21B 49/06; E21B 7/061; E21B 17/14

See application file for complete search history.

(56) References Cited

U.S. PATENT DOCUMENTS

| | | | | |
|---|---|---|---|---|
| 5,012,877 | A * | 5/1991 | Winters | E21B 7/061 175/81 |
| 5,740,864 | A * | 4/1998 | de Hoedt | E21B 7/061 166/387 |
| 2001/0035302 | A1* | 11/2001 | Desai | E21B 10/54 175/379 |
| 2008/0110629 | A1* | 5/2008 | Belew | E21B 10/61 166/55.1 |
| 2009/0277629 | A1* | 11/2009 | Mendez | E21B 47/14 166/250.01 |
| 2016/0319656 | A1* | 11/2016 | Downie | G01P 3/48 |
| 2018/0238145 | A1* | 8/2018 | Head | E21B 7/046 |

* cited by examiner

*Primary Examiner* — Tara Schimpf
*Assistant Examiner* — Lamia Quaim
(74) *Attorney, Agent, or Firm* — Ewing & Jones, PLLC

(57) ABSTRACT

An alignable guidance device includes a tube section and a casing milling shoe within the tube section, a pre-contoured tube within the casing milling shoe that terminates in an exit point in the tube section, the pre-contoured tube exiting the tube section at an exit angle of between 0° and 45°. The alignable guidance device also includes guidance sensors within the tube section and a guidance device EM communications system within the tube section, the guidance device EM communications system in electrical communication with the guidance sensors.

16 Claims, 10 Drawing Sheets

ALIGNABLE GUIDANCE DEVICE FOR CASING ENTRY MILLING AND CEMENTING OPERATIONS

CROSS-REFERENCE TO RELATED APPLICATIONS

This application is a continuation in part of U.S. application Ser. No. 18/518,033 filed Nov. 22, 2023, a nonprovisional application that claims priority from U.S. provisional application No. 63/434,987, filed Dec. 23, 2022, which is incorporated by reference herein in its entirety.

TECHNICAL FIELD/FIELD OF THE DISCLOSURE

The present disclosure relates to a downhole casing milling guidance device in reference to an in-situ casing.

BACKGROUND OF THE DISCLOSURE

During the life cycle of an oil well, an operator may need to gain hydraulic access to an existing cased wellbore when the wellbore is not accessible by typical re-entry procedures. For example, during the creation of the wellbore, if the wellbore penetrates a zone with pressure higher than the hydrostatic mud weight in the wellbore and pressure control systems fail, a blowout may occur that may result in the release of oil and/or natural gas. One method to control such a blowout is to drill a relief well to intercept the blowout wellbore.

As another example, at the end of a well's life cycle, a well is plugged and abandoned. Occasionally, the plugged and abandoned (P&A) well is improperly abandoned and may leak. Such a situation may require the drilling of an intercept well to fix and properly abandon the well.

In another example, during the drilling or completion phase of the well, a tubular "fish" or damaged tubular section may have been left in the well. An intercept well may be drilled to re-enter the wellbore to secure continued use of the wellbore and/or set abandonment plugs.

To gain hydraulic access to the existing cased wellbore, an operator may need to drill the intercept wellbore. Once the operator has drilled the intercept wellbore sufficiently close to the existing wellbore, a casing entry tool may be used to penetrate the existing tubular and gain hydraulic access thereto.

SUMMARY

In an embodiment, an alignable guidance device is shown. The alignable guidance device includes a tube section and a casing milling shoe within the tube section, a pre-contoured tube within the casing milling shoe that terminates in an exit point in the tube section, the pre-contoured tube exiting the tube section at an exit angle of between 0° and 45°. The alignable guidance device also includes guidance sensors within the tube section and a guidance device EM communications system within the tube section, the guidance device EM communications system in electrical communication with the guidance sensors.

In another embodiment, an alignable guidance device is shown. The alignable guidance device includes a tube section and a casing milling shoe within the tube section, a pre-contoured tube within the casing milling shoe that terminates in an exit point in the tube section, the pre-contoured tube exiting the tube section at an exit angle of between 0° and 45°. The alignable guidance device also includes guidance sensors within the tube section and a wireline transceiver positioned within the tube section in electrical connection with the guidance sensors and the surface of the earth.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
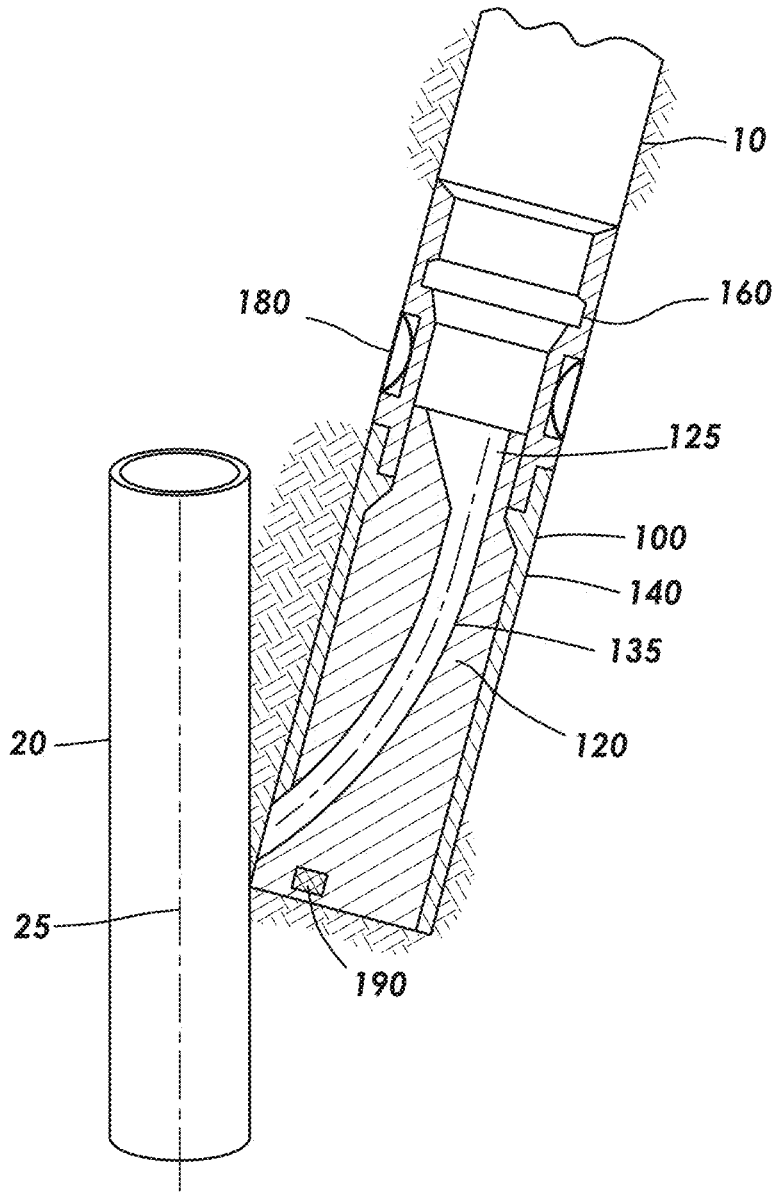
FIG. 1 is a vertical cross-sectional view of an alignable guidance device consistent with certain embodiments of the present disclosure in proximity to casing.
Figure 1A:
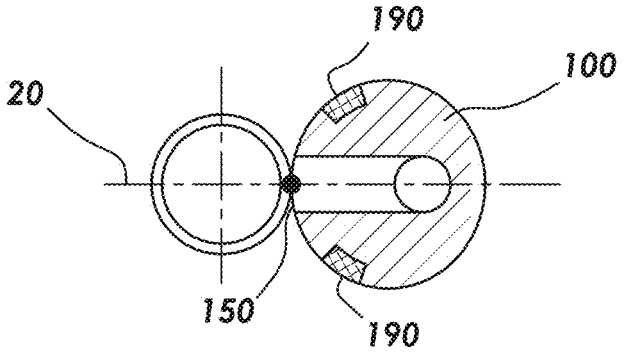
FIG. 1A is a horizontal cross-sectional view of an alignable guidance device consistent with certain embodiments of the present disclosure in proximity to casing.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Figure 1C:
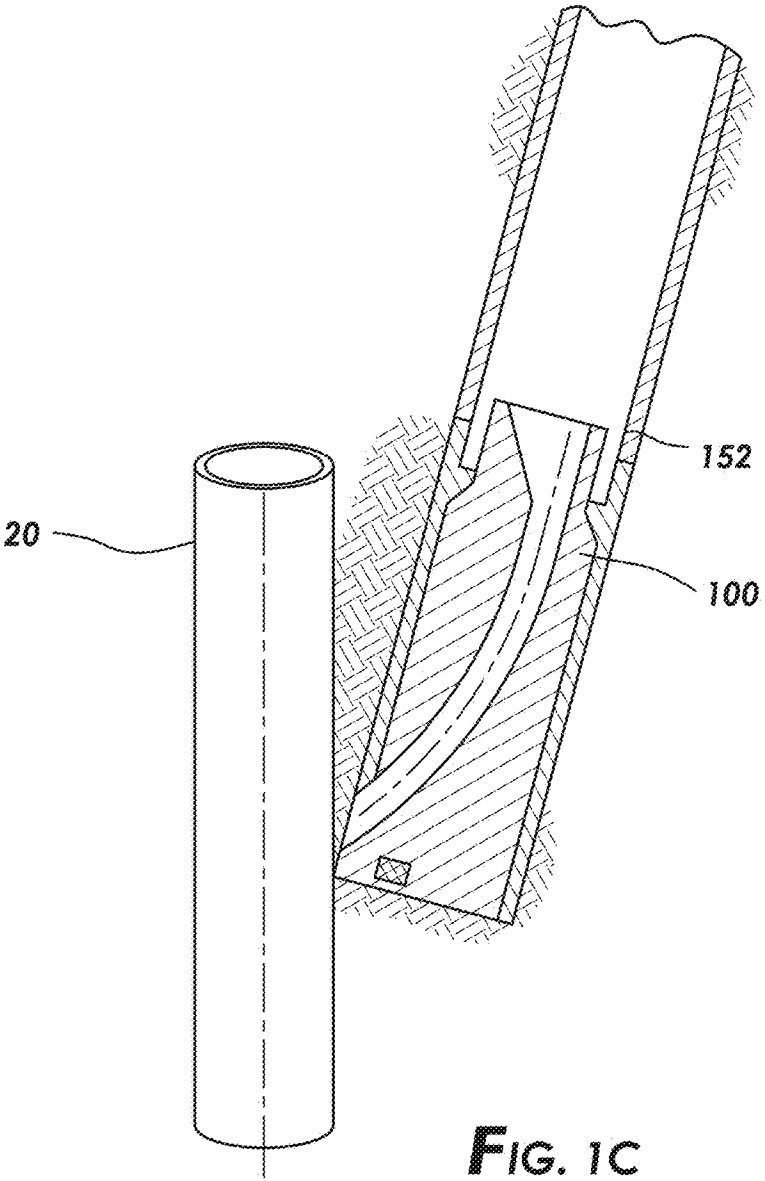
FIG. 1C is a depiction of an alignable guidance device proximate casing.
Figure 1B:
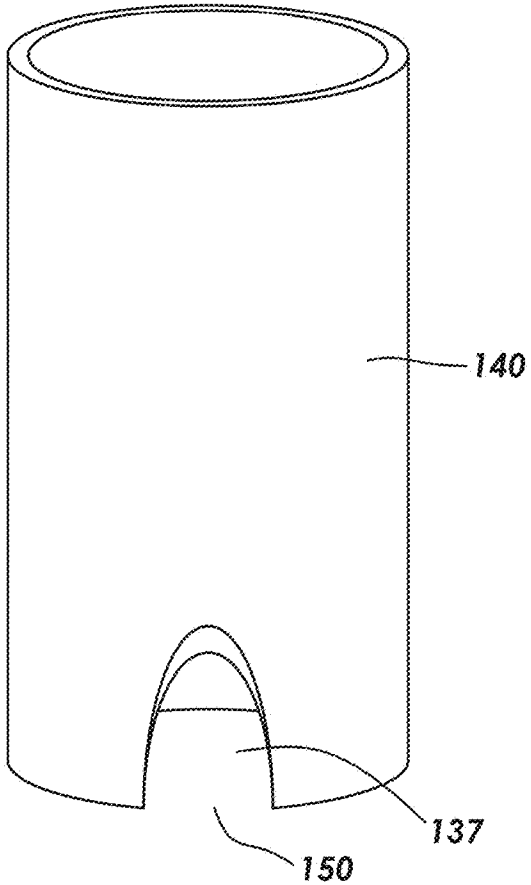
FIG. 1B is a portion of the tube section of an alignable guidance device consistent with certain embodiments of the present disclosure.

The present disclosure includes embodiments of alignable guidance device 100 for guiding a casing milling tool to in-situ casing 20. As shown in FIG. 1, alignable guidance device 100 includes casing milling shoe 120 within tube section 140. Tube section 140 surrounds casing milling shoe 120. Within casing milling shoe 120 is pre-contoured tube 135. Pre-contoured tube 135 terminates in exit point 150 in tube section 140 as shown in FIG. 1B.

In one non-limiting example, pre-contoured tube 135 is in the shape of a slim curved bore inside tube section 140. Pre-contoured tube 135 exits tube section 140 radially at an exit angle of between 0° and 45°, or between 10° and 30°. In the non-limiting example shown in FIGS. 1 and 1C, the exit angle is 20°. In certain embodiments, pre-contoured tube 135 has coned starting hole 125. Coned starting hole 125 may act to ease the entry of a milling tool, such as a micro turbine milling or micro motor milling tool that may be run through casing milling shoe 120 before the milling operation begins. In certain embodiments, as shown in FIG. 1B, tube section 140 may include notch 137 near or at exit point 150. Notch 137 may assist in maintaining the orientation between alignable guidance device 100 and in-situ casing 20.

Casing milling shoe 120 may be manufactured in a casting mold process and be made of epoxy, cement, or steel, for example. In other embodiments, casing milling shoe 120 may be manufactured by mechanical milling, 3D printing, casting technique, or a welding process, such as a pre-contoured steel tube welded within tube section 140.

As further shown in FIG. 1, in certain embodiments, alignable guidance device 100 may also include guidance sensor(s) 190. Guidance sensor(s) 190 may act to orient casing milling shoe 120 so that casing milling shoe 120 is properly set at centerline 25 of in-situ casing 20. An example of guidance sensor(s) 190 may be found in U.S. provisional application No. 63/433,672, filed Dec. 19, 2022, which is incorporated herein by reference.

Figure 9:
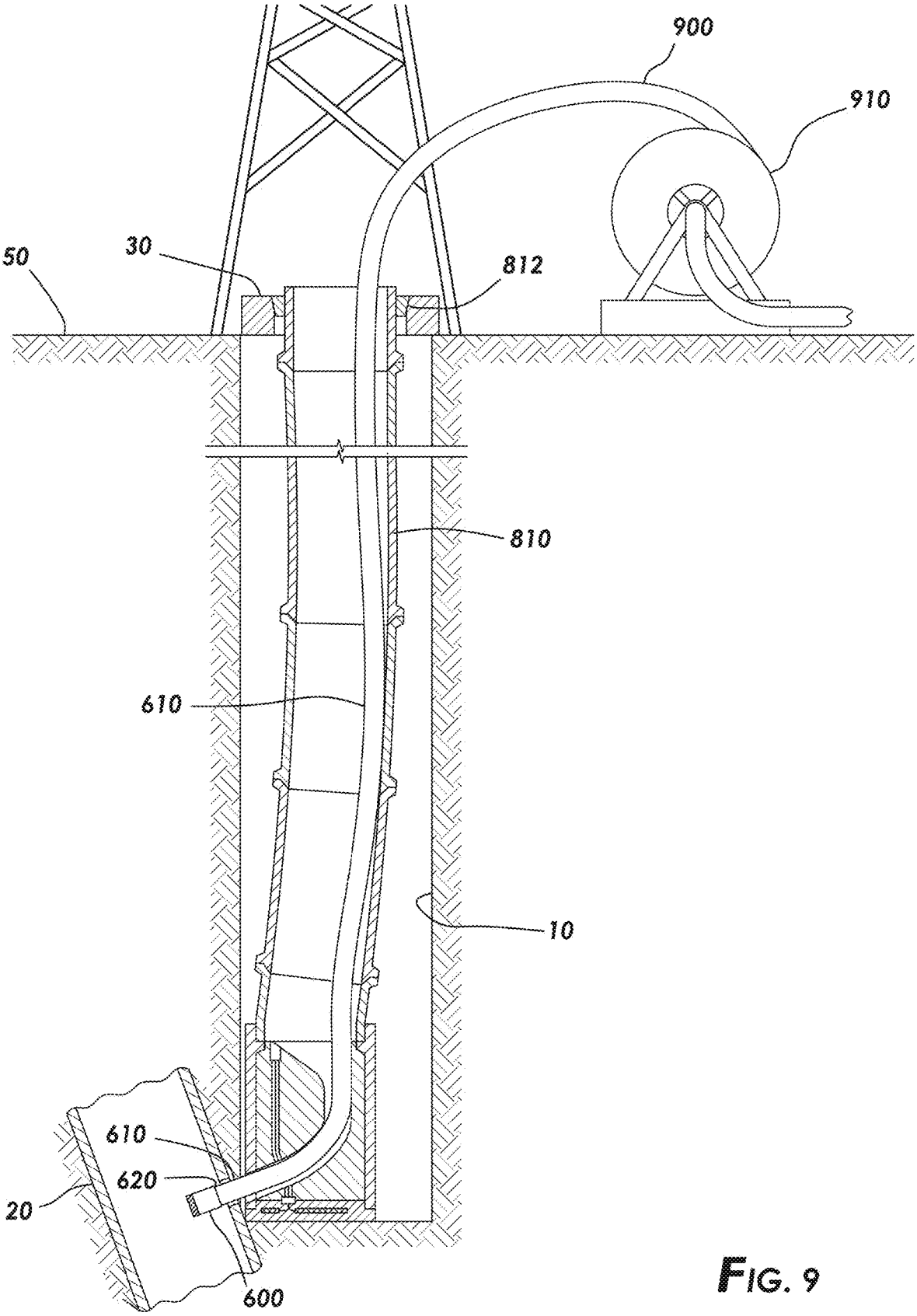
FIG. 9 depicts a CT unit consistent with certain embodiments of the present disclosure.

In some embodiments, alignable guidance device 100 may be run-in using casing, coiled tubing, or drill string. FIG. 1C depicts alignable guidance device 100 connected to casing 152. As shown in FIG. 9, alignable guidance device 100 may be a part of deployment string 810. Like alignable guidance device 100, deployment string 810 may be run-in using casing, coiled tubing, or drill string. Deployment string 810 may be held at drill rig floor 30 using pipe clips 812. During operation, deployment string 810 may be lowered into open hole wellbore 10.

Alignable guidance device 100 may then be aligned based on guidance sensors 190, for example, such that alignable guidance device 100 is centered on the centerline of in-situ casing 20. After alignment, alignable guidance device 100 may be held in place from the surface using a top drive, rotary table, or kelly drive, which holds the casing, tubing, or drill string in place. In other embodiments, alignable guidance device 100 may be anchored using clamps or cement. In some embodiments, no release mechanism exists to release alignable guidance device 100 once anchored.

Figure 2:
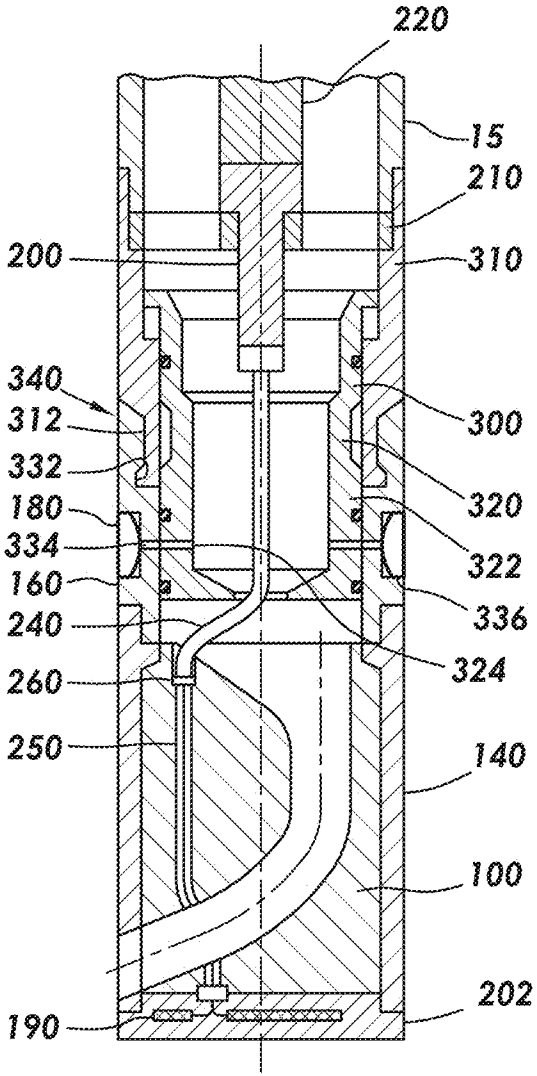
FIG. 2 is a vertical cross-sectional view of an alignable guidance device in conjunction with a retrievable EM tool and a hydraulic release tool consistent with certain embodiments of the present disclosure.

In yet other embodiments, as shown in FIG. 2, alignable guidance device 100 may be attached to collet 160, which is attached to tube section 140 adaptable for holding a running tool, described hereinafter. Situated within collet 160 is open hole hydraulic set packer 180. In certain embodiments, as shown in FIG. 2, alignable guidance device 100 may work in conjunction with retrievable EM tool 200 and hydraulic release tool 300. Prior to milling, hydraulic release tool 300 may be positioned in wellbore 10, for example, along with alignable guidance device 100 and retrievable EM tool 200. FIG. 2 depicts hydraulic release tool 300 in its run-in position. In other embodiments, EM signals may be passed up-hole using mud pulse or wireline transmission. In certain embodiments, when EM signals are transmitted via wireline, the wireline may be deployed via coiled tubing.

Hydraulic release tool 300 is connected to run-in string 15 with connector latch portion 310 of hydraulic release tool 300. The combination of connector latch portion 310, movable latch portion 320, and collet 160 act to form latch 340. In certain embodiments, centralizer 210 holds retrievable EM tool 200 in place during the deployment phase and the alignment phase of the casing entry drilling method, described herein below.

When in the run-in position, such as during the deployment phase, male snap arm 312 of connector latch portion 310 is held in collet recess 332 of collet 160 by shoulder 322 of movable latch portion 320. Movable latch portion 320 further includes movable latch portion orifice 324, which is aligned with collet orifice 334 and both are adapted to pass fluid to open hole hydraulic set packer 180 positioned within packer inflation element cut out 336 of collet 160.

During the deployment phase and the alignment phase, retrievable EM tool 200 is positioned within run-in string 15. Retrievable EM tool 200 may be held in place with centralizer 210 positioned between retrievable EM tool and connector latch portion 310. Retrievable EM tool 200 may contain electronics 220. Retrievable EM tool 200 may be connected via wireline 240 to power and communication cable 250. Wireline 240 and power and communication cable 250 may be connected together with decoupling device 260. Decoupling device 260 may be any device capable of carrying communications and power, but able to decouple wireline 240 and power and communications cable 250 when retrievable EM tool 200 is removed from wellbore 10.

Power and communications cable 250 is connected to guidance sensor(s) 190 to provide power to the sensors and to transmit sensor information to retrievable EM tool 200. The guidance sensor(s) 190 in some embodiments may be disposed in an end plate 202 included as part of the tube section 140 of alignable guidance device 100. In certain embodiments, retrievable EM tool 200 may gather sensor information and determine the orientation of casing milling shoe 120. Retrievable EM tool 200 may then transmit the orientation of casing milling shoe 120 to the surface through a telemetry system. In other embodiments, retrievable EM tool 200 may transmit sensor information to the surface through a telemetry system for determination of the orientation of casing milling shoe 120 at the surface.

After the deployment phase, the alignment phase begins. During the alignment phase, power is delivered to guidance sensor(s) 190 and data from guidance sensor(s) 190 may be sent to retrievable EM tool 200, wherein the orientation of casing milling shoe 120 may be determined in retrievable EM tool 200 or at the surface. Power may be supplied from a battery, an MWD, or from the surface. If the orientation of casing milling shoe 120 is not facing centerline 25 of in-situ casing 20, casing milling shoe 120 may be rotated by rotating run-in string 15.

Figure 3:
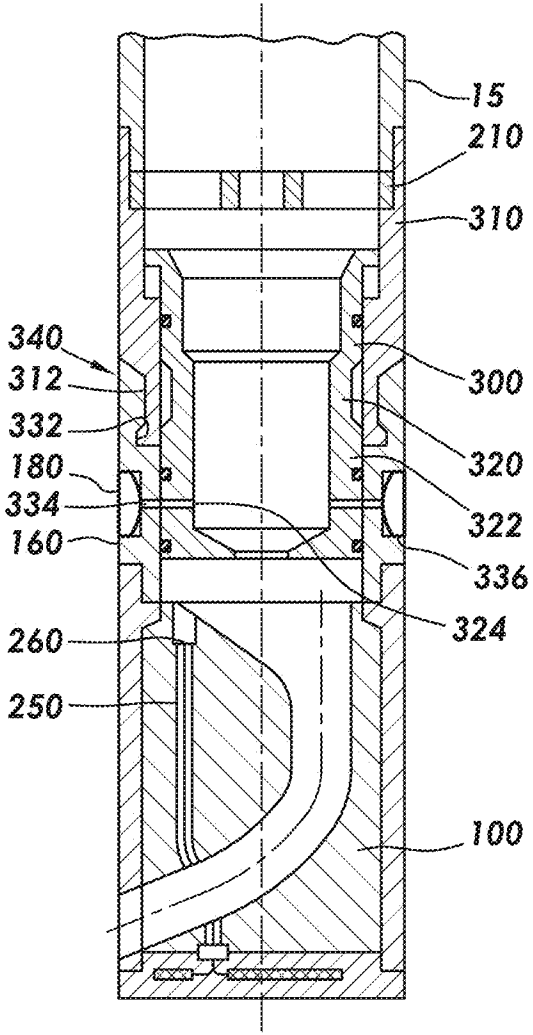
FIG. 3 is a vertical cross-sectional view of an alignable guidance device in conjunction with a hydraulic release tool consistent with certain embodiments of the present disclosure.

Once casing milling shoe 120 is facing centerline 25 of in-situ casing 20, retrievable EM tool 200 may be removed as shown in FIG. 3 during the EM tool removal phase. As described above, wireline 240 may be detached from power and communication cable 250 with decoupling device 260 as retrievable EM tool 200 is removed from wellbore 10.

Figure 5:
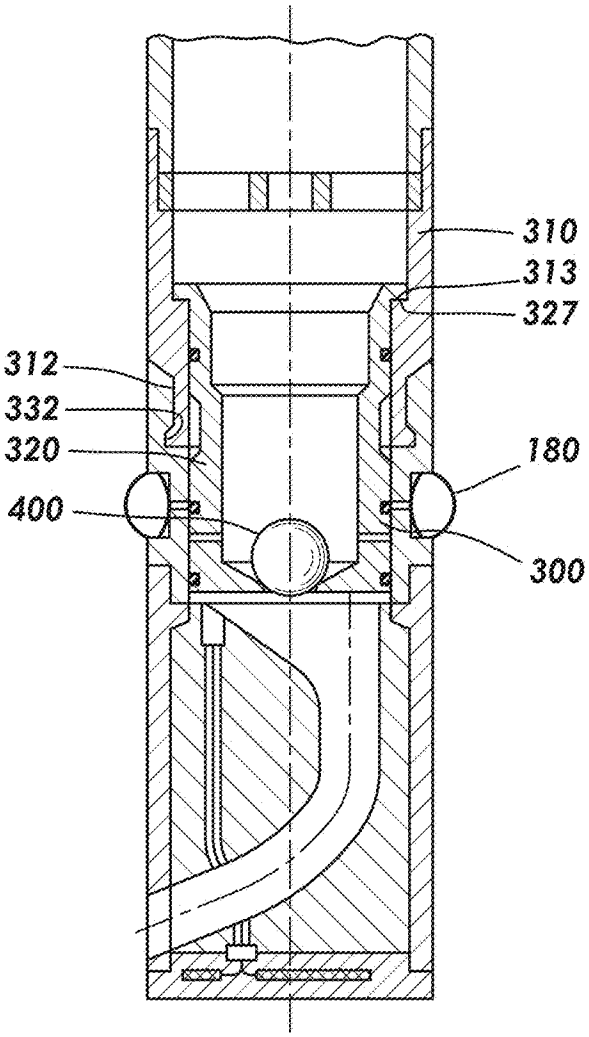
FIG. 5 is a vertical cross section of an alignable guidance device in conjunction with the hydraulic release tool in its release position consistent with certain embodiments of the present disclosure.

Following the EM removal phase, tool set phase begins. Ball 400 is dropped into wellbore 10 and seats on seat 350 of connector latch portion 310, as shown in FIG. 4. Next, as shown in FIGS. 4 and 5, fluid is pumped into wellbore 10 and through movable latch portion orifice 324 and collet orifice 334, which expands open hole hydraulic set packer 180 to anchor in place collet 160 and therefore alignable guidance device 100. In addition, the weight of the fluid causes hydraulic release tool 300 to move downhole into its release position. In its release position, movable latch portion 320 is pushed downhole such that male snap arm 312 is no longer held in collet recess 332 by shoulder 322. Movable latch portion 320 is pushed down until lip 327 of movable latch portion 320 contacts inner diameter profile 313 of connector latch portion 310, locking movable latch portion 320 to connector latch portion 310 as shown in FIG. 5.

Figure 4A:
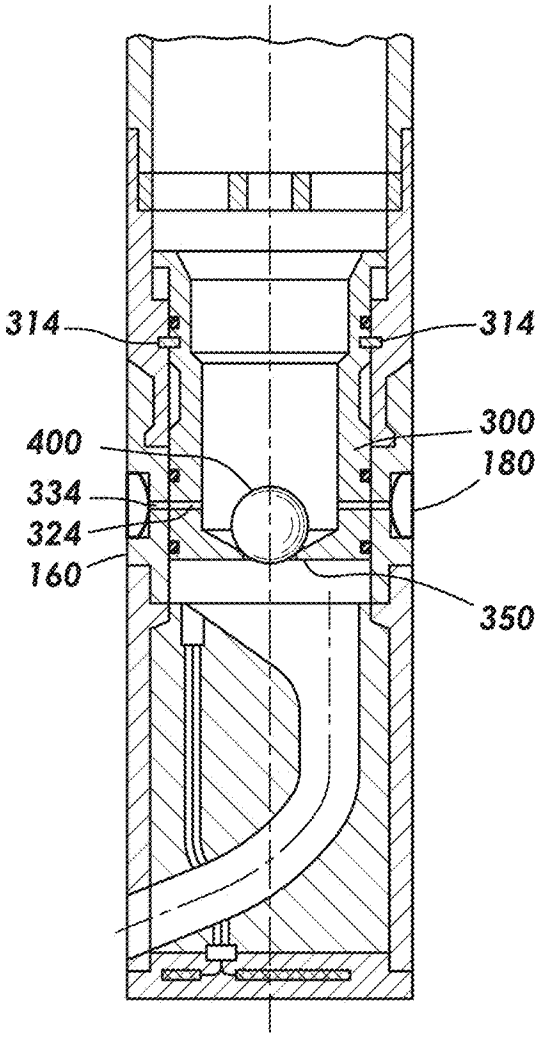
FIG. 4A is a vertical cross-sectional view of an alignable guidance device in conjunction with a hydraulic release tool including a shearing device with a ball seated consistent with certain embodiments of the present disclosure.
Figure 4:
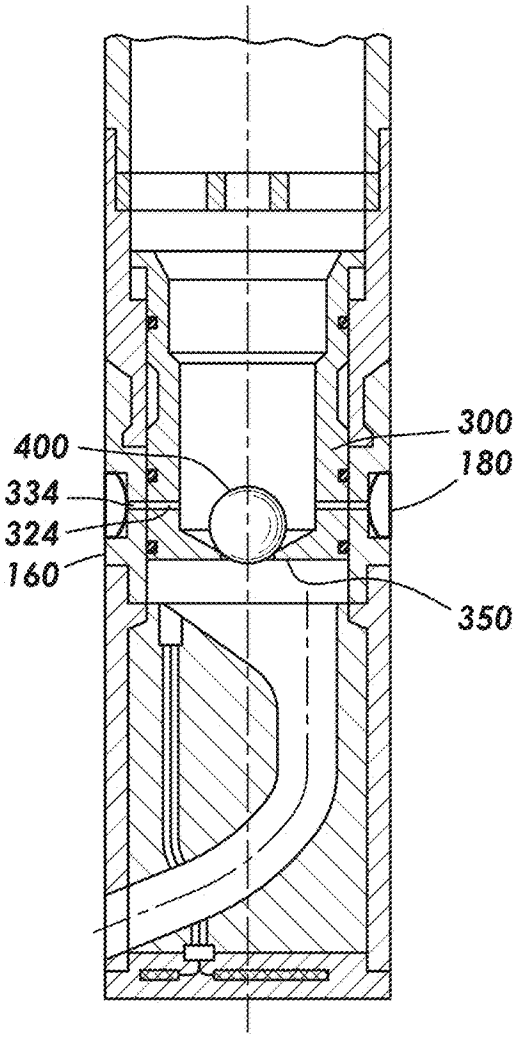
FIG. 4 is a vertical cross-sectional view of an alignable guidance device in conjunction with a hydraulic release tool with a ball seated consistent with certain embodiments of the present disclosure.

In an alternate tool set phase, depicted in FIG. 4A, shearing device 314, such as shear pins or shear bolts, may connect hydraulic release tool 300 to connector latch portion 310. Ball 400 is dropped into wellbore 10 and seats on seat 350 of connector latch portion 310, as shown in FIG. 4. Next, as shown in FIGS. 4A and 5, fluid is pumped into wellbore 10 and through movable latch portion orifice 324 and collet orifice 334 at a first pressure. The first pressure is insufficient to shear shearing device 314. Once the open hole hydraulic set packer 180 has been inflated, the fluid pressure is increased from the first pressure to the second pressure. The second pressure is sufficient to shear shearing device 314. Once shearing device 314 is sheared, the pressure of the fluid causes hydraulic release tool 300 to move downhole into its release position. In its release position, movable latch portion 320 is pushed downhole such that male snap arm 312 is no longer held in collet recess 332 by shoulder 322. Movable latch portion 320 is pushed down until lip 327 of movable latch portion 320 contacts inner diameter profile 313 of connector latch portion 310, locking movable latch portion 320 to connector latch portion 310 as shown in FIG. 5.

Figure 8A:
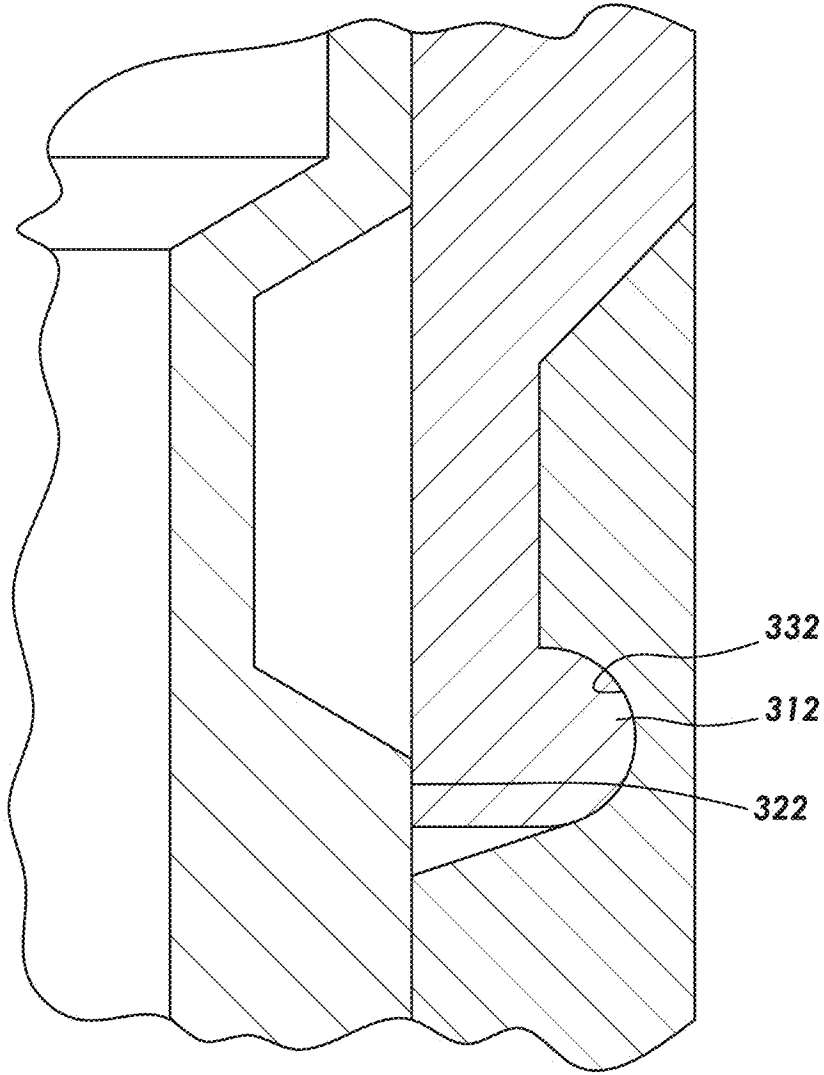
FIGS. 8*a*-8*c* show the operation of a latch consistent with certain embodiments of the present disclosure.
Figure 8C:
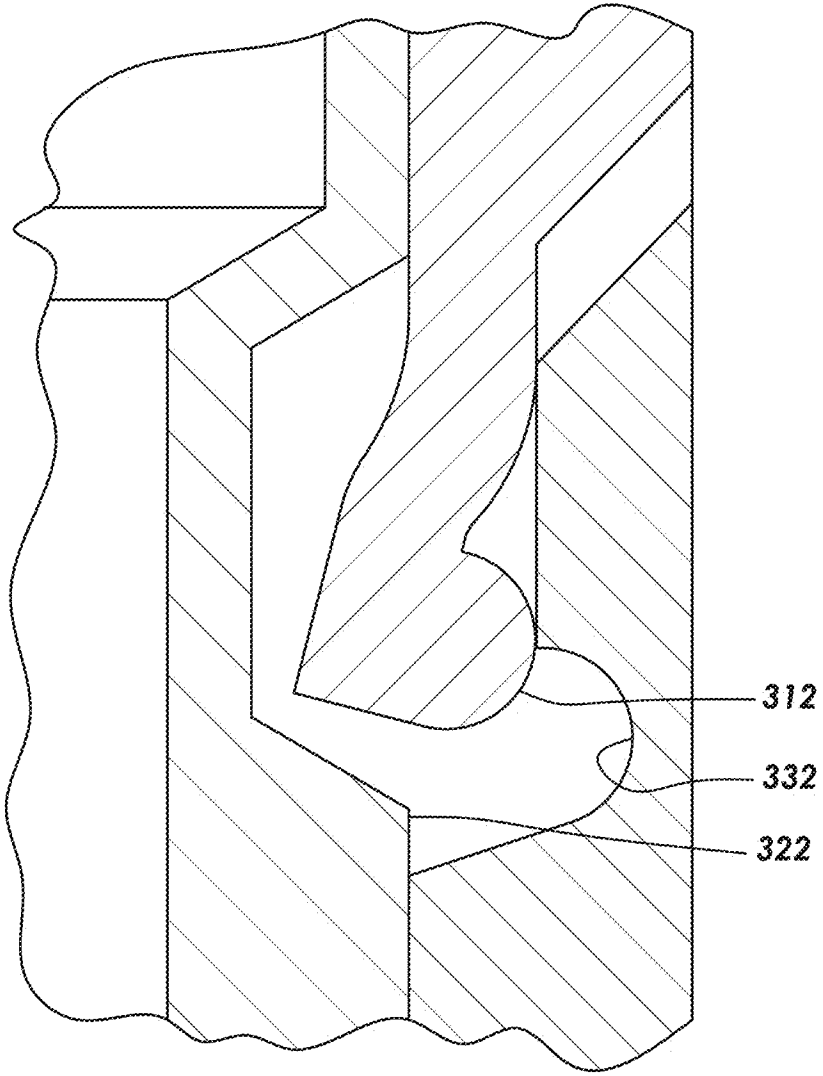
Figure 8B:
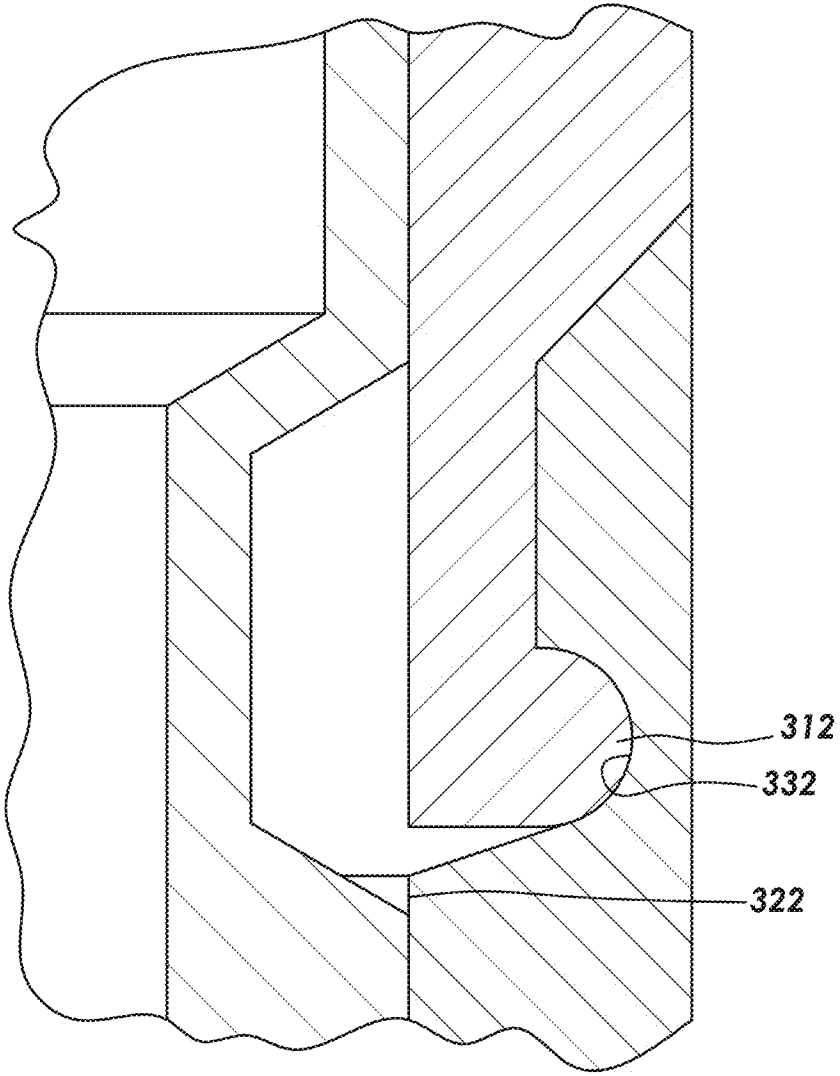

The actions to release alignable guidance device 100 from run-in string 15 are shown in detail in FIGS. 8*a*-8*c*. As shown in FIG. 8*a*, male snap arm 312 is positioned within collet recess 332 by shoulder 322. Male snap arm 312 and collet recess 332 may together form a cantilever or annular snap-fit joint, which is held and locked in engagement by shoulder 322, as shoulder 322 prevents male snap arm 312 from moving radially inward and thus disengaging from collet recess 332. FIG. 8*b* shows how movable latch portion 320 is pushed downhole such that shoulder 322 no longer holds male snap arm 312. FIG. 8*c* depicts how male snap arm 312 retracts from collet recess 332, thus allowing for the separation of connector latch portion 310 and tube section 140.

Figure 7:
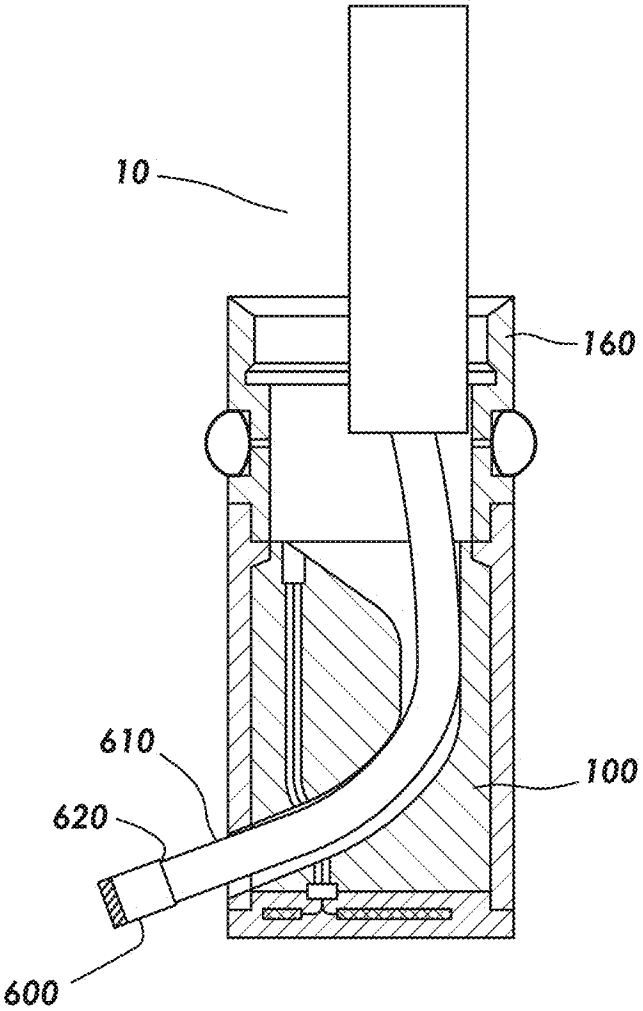
FIG. 7 depicts the insertion of a casing milling tool inserted into the alignable guidance device.
Figure 6:
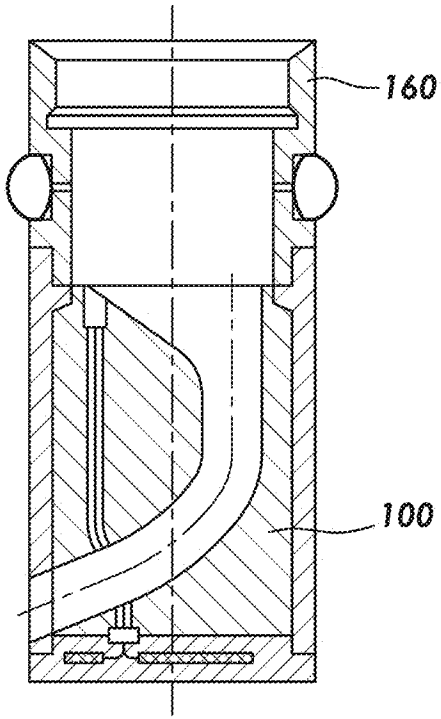
FIG. 6 depicts the collet and alignable guidance device anchored in place in the hole.
Figure 7A:
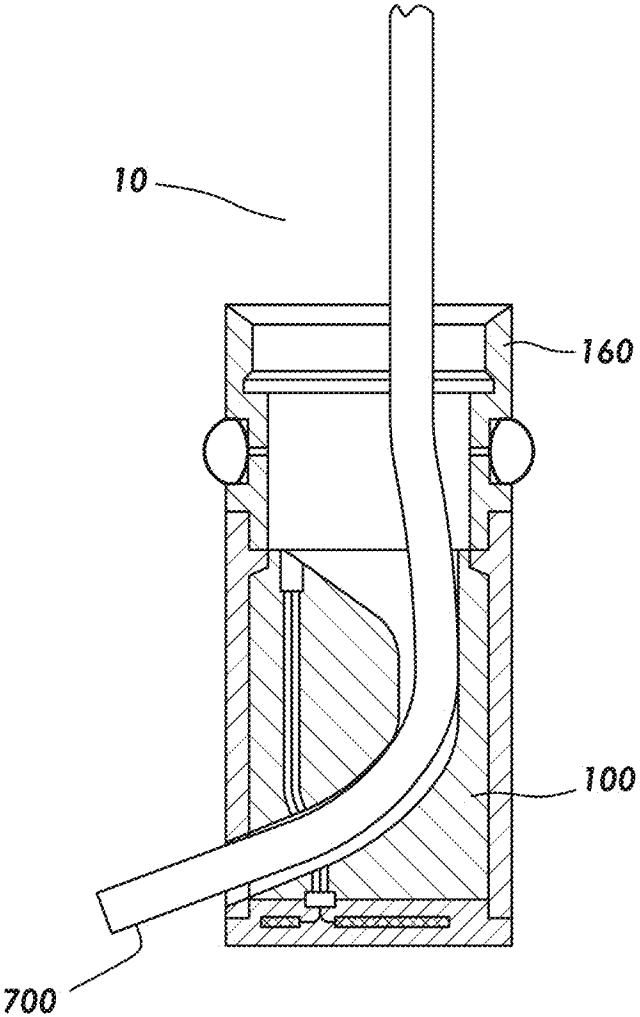
FIG. 7A depicts the insertion of a cement stinger inserted into the alignable guidance device.

Run-in string 15 is removed, along with connector latch portion 310 and movable latch portion 320. As shown in FIG. 6, collet 160 and alignable guidance device 100 remain anchored in the hole. As shown in FIG. 7, casing milling tool 600 may be run in wellbore 10 through alignable guidance device 100. Casing milling tool 600 may then drill through tube section 140 and into in-situ casing 20 to form a fluid channel from inside the in-situ casing 20 into tube section 140 to wellbore 10 (or casing 152 for the embodiment shown in FIG. 1C) through pre-contoured tube 135. One example of a suitable casing milling tool 600 is a micro turbine cutter described in German patent application DE 10 2020 205 764 A1, which is incorporated herein by reference. In certain embodiments, casing milling tool 600 upon cutting a hole in in-situ casing 20 may then be removed, and, in certain embodiments as shown in FIG. 7A, cement stinger 700 may be inserted in alignable guidance device 100, where cement is pumped through the hole in in-situ casing 20 and into in-situ casing 20. In certain embodiments, cement stinger 700 may extend into in-situ casing 20.

In other embodiments, after casing milling tool 600 has drilled through in-situ casing 20, the microturbine cutter may be released from coiled tubing operating string 610 within in-situ casing 20. FIG. 9 depicts CT unit 900, of which coiled tubing operating string 610 is a part. Coiled tubing operating string 610 may be deployed from CT reel 910 located at surface 50. The release method for releasing the microturbine cutter from coiled tubing operating string 610 may be, for example and without limitation, a change in pressure, a ball drop, electrical release, or a pumped down chemical source release. Once casing milling tool 600 is released, cementing may begin through coiled tubing operating string 610. Cementing may fill in-situ casing 20 beginning at the bottom of in-situ casing 20. In some embodiments, cementing may cease once coiled tubing end 620 of coiled tubing operating string 610 is within alignable guidance device 100.

Figure 10:
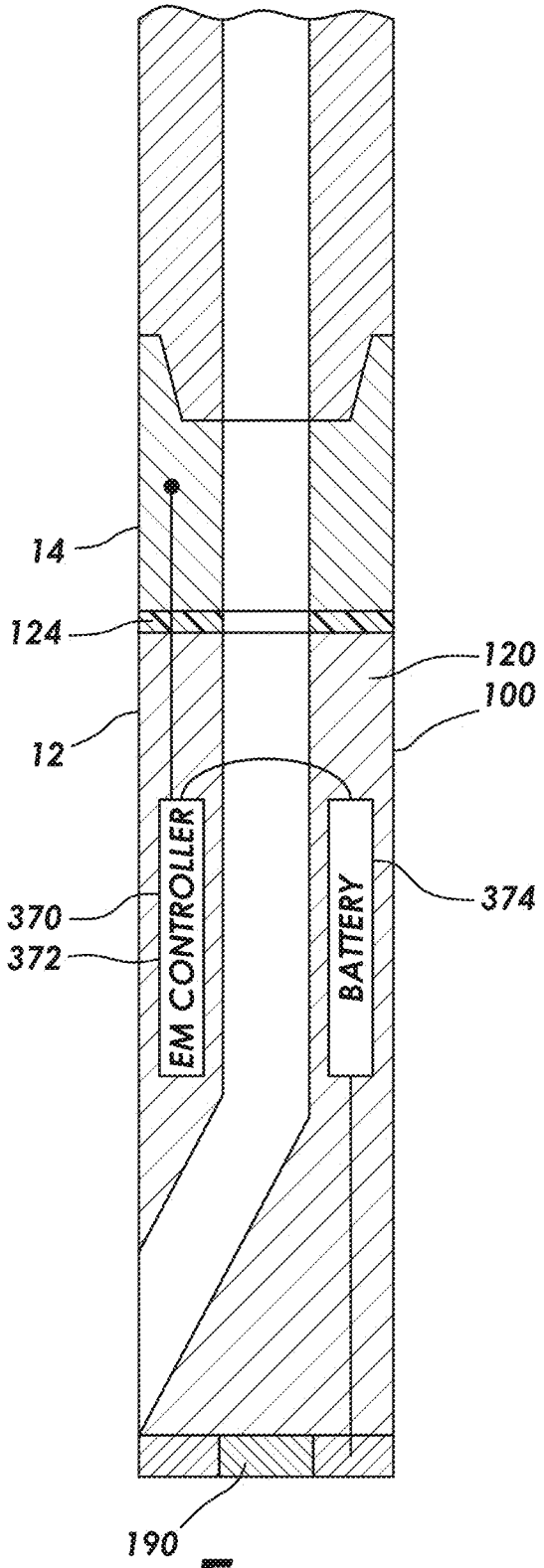
FIG. 10 depicts an embodiment of the alignable guidance device consistent with certain embodiments of the present disclosure.

In other embodiments as shown in FIG. 10, alignable guidance device 100 may include guidance device EM communication system 370. Guidance device EM communication system 370 may include EM controller 372 electrically connected to battery 374 and both positioned within casing milling shoe 120. Guidance sensor 190 may be in electrical communication with guidance device EM system 370. In some embodiments, as shown in FIG. 10, alignable guidance device 100 may include gap 124, which may be formed of electrical insulation. Gap 124 may be formed between lower portion of tool string 14 and upper portion of the tool string 12. As guidance device EM communication system 370 remains in wellbore 10 during orientation process and also during casing entry milling, drilling and cementing operation, data from guidance sensor 190 may be transmitted throughout these processes. Further, guidance device EM communication system 370 may transmit data from guidance sensor 190 while tripping out of wellbore 10.

Figure 11:
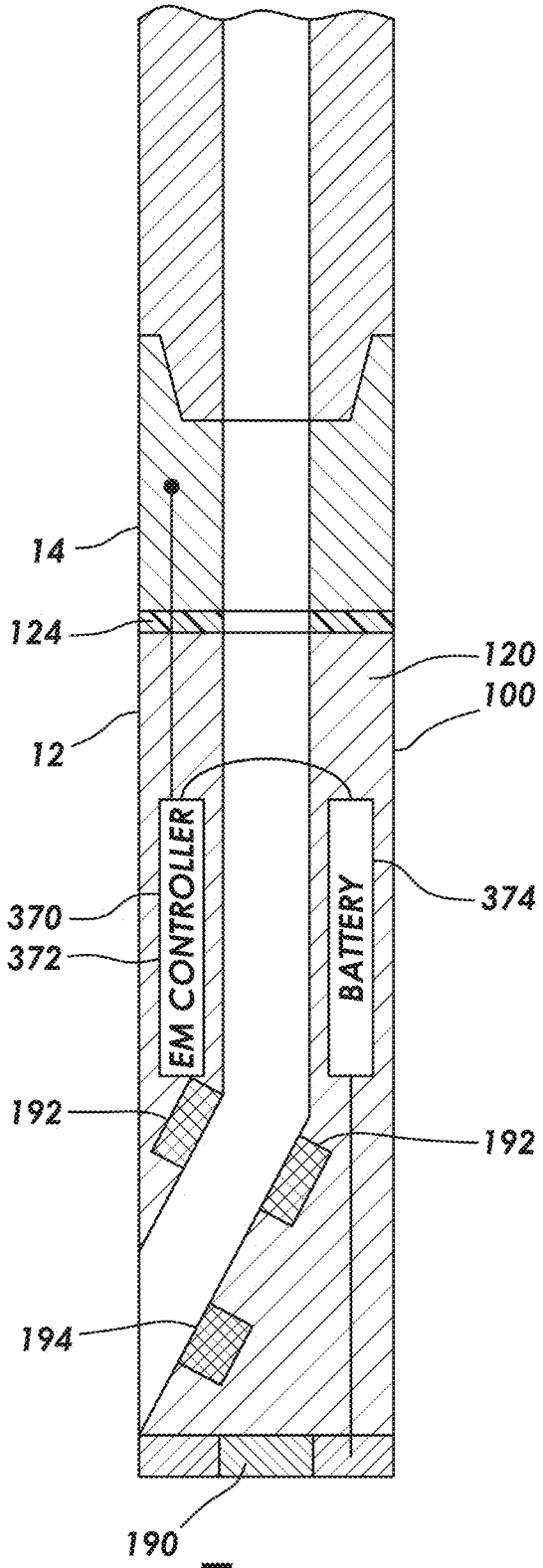
FIG. 11 depicts an embodiment of the alignable guidance device consistent with certain embodiments of the present disclosure.

In yet other embodiments as shown in FIG. 11, in addition to orientation sensor 190, alignable guidance device 100 may include other sensors in electrical communication with guidance device EM system 370. For example, as shown in FIG. 11, alignable guidance device 100 may include milling/drilling speed/rate of penetration sensor 192 or turbine rpm sensor 194.

Figure 12:
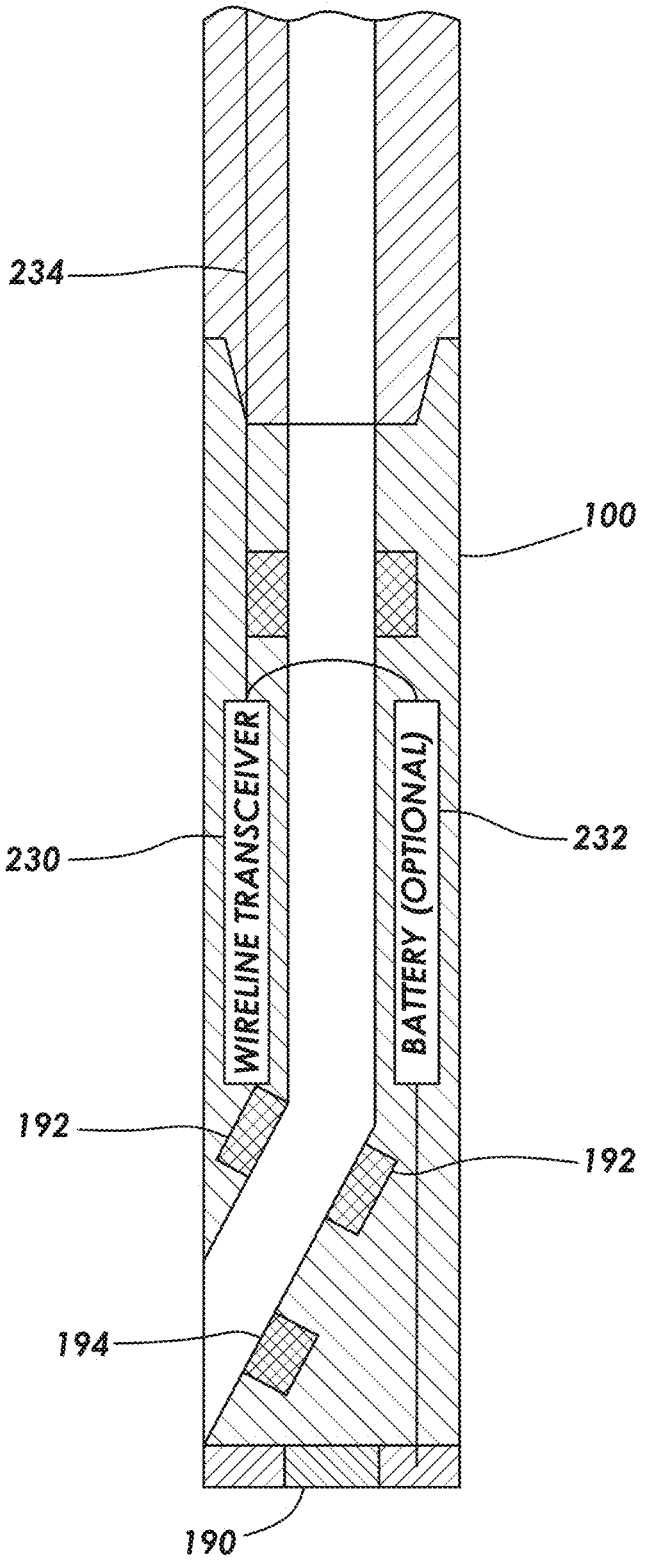
FIG. 12 depicts an embodiment of the alignable guidance device consistent with certain embodiments of the present disclosure.

In still another embodiment, as shown in FIG. 12, instead of guidance device EM communication system 370, wireline transceiver 230 may transmit data to the surface through wireline 234. In some embodiments, wireline transceiver 230 may be electrically connected to battery 232. In other embodiments, battery 232 may be omitted, such as when power is transmitted to wireline transceiver 230 from the surface. Alignable guidance device 100 may include other sensors in electrical communication with guidance device EM communication system 370. For example, as shown in FIG. 11, alignable guidance device 100 may include milling/drilling speed/rate of penetration sensor 192 or turbine rpm sensor 194.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. An alignable guidance device, comprising:

a tube section, the tube section including a lower tube portion and an upper tube portion, the lower tube portion having an end plate;

a casing milling shoe within the tube section, a pre-contoured tube within the casing milling shoe that terminates in an exit point in the tube section;

guidance sensors within the end plate of the tube section, proximate the exit point;

a guidance communications system within the lower tube section, the guidance communications system in electrical communication with the guidance sensors; and a gap, the gap including electrical insulation, the gap positioned between the lower tube portion and the upper tube portion.

2. The alignable guidance device of claim 1 further comprising a turbine rpm sensor positioned within the tube section.

3. The alignable guidance device of claim 1, wherein the guidance communications system includes a controller and a battery.

4. The alignable guidance device of claim 1, wherein the pre-contoured tube is in the shape of a slim curved bore section within the tube section.

5. The alignable guidance device of claim 1, wherein the pre-contoured tube has a coned starting hole opposite the exit of the pre-contoured tube.

6. The alignable guidance device of claim 1, wherein the casing milling shoe is made of epoxy, cement, or steel.

7. The alignable guidance device of claim 1, wherein the tube section has a notch proximate the exit point.

8. An alignable guidance device, comprising:

a tube section, the tube section including a lower tube portion and an upper tube portion the lower tube portion having an end plate;

a casing milling shoe within the tube section, a pre-contoured tube within the casing milling shoe that terminates in an exit point in the tube section;

guidance sensors within the end plate of the tube section, proximate the exit point;

a wireline transceiver positioned within the lower portion of the tube section in electrical connection with the guidance sensors and the surface of the earth; and a gap, the gap including electrical insulation, the gap positioned between the lower tube portion and the upper tube portion.

9. The alignable guidance device of claim 8, further comprising a battery positioned in the tube section, the battery in electrical connection with the wireline transceiver.

10. The alignable guidance device of claim 8 further comprising a turbine rpm sensor positioned within the tube section and in electrical communication with the wireline transceiver.

11. The alignable guidance device of claim 8, wherein the pre-contoured tube is in the shape of a slim curved bore section within the tube section.

12. The alignable guidance device of claim 8, wherein the pre-contoured tube has a coned starting hole opposite the exit of the pre-contoured tube.

13. The alignable guidance device of claim 8, wherein the casing milling shoe is made of epoxy, cement, or steel.

14. The alignable guidance device of claim 8, wherein the tube section has a notch proximate the exit point.

15. The alignable guidance device of claim 8 further comprising a rate of penetration sensor positioned in the lower tube portion proximate the pre-contoured tube.

16. The alignable guidance device of claim 15 further comprising a turbine rpm sensor positioned in the lower tube portion proximate the pre-contoured tube.

* * * * *